US011933322B1

(12) United States Patent
Alghanim et al.

(10) Patent No.: US 11,933,322 B1
(45) Date of Patent: Mar. 19, 2024

(54) ADJUSTABLE BALANCE DRUM SLEEVE CLEARANCE

(71) Applicant: SAUDI ARABIAN OIL COMPANY, Dhahran (SA)

(72) Inventors: Hamad Ali Alghanim, As Saffaniyah (SA); Mutlaq F. Azmi, As Saffaniyah (SA); Mubarak I. Alabdulaaly, AlFakhriyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/187,504

(22) Filed: Mar. 21, 2023

(51) Int. Cl.

| | |
|---|---|
| ***F04D 29/66*** | (2006.01) |
| ***F04D 13/02*** | (2006.01) |
| ***F04D 29/041*** | (2006.01) |
| ***F04D 29/051*** | (2006.01) |
| ***F04D 29/40*** | (2006.01) |

(52) U.S. Cl.
CPC ..... *F04D 29/669* (2013.01); *F04D 13/02* (2013.01); *F04D 29/041* (2013.01); *F04D 29/051* (2013.01); *F04D 29/406* (2013.01)

(58) Field of Classification Search
CPC ..... F04D 29/041; F04D 29/051
See application file for complete search history.

(56) References Cited

U.S. PATENT DOCUMENTS 4,538,960 A 9/1985 Iino et al.

OTHER PUBLICATIONS

CN112392773 and english translation (Year: 2019).*

* cited by examiner

*Primary Examiner* — Brian O Peters
(74) *Attorney, Agent, or Firm* — Osha Bergman Watanabe & Burton LLP

(57) ABSTRACT

A system includes a balance drum shaft, a rotating balance drum, a stationary balance drum, an adjustable radial clearance, and a gear wheel. The balance drum shaft has a rotational ability. The rotating balance drum is connected to and disposed circumferentially around the balance drum shaft. The stationary balance drum has an outer circumferential surface, an inner circumferential surface, and drum teeth machined into the outer circumferential surface of the stationary balance drum. The stationary balance drum is disposed circumferentially around the rotating balance drum. The adjustable radial clearance is delineated by an outside of the rotating balance drum and the inner circumferential surface of the stationary balance drum. The gear wheel includes gear teeth. The gear teeth and the drum teeth are configured to interact to rotate the stationary balance drum upon rotation of the gear wheel.

16 Claims, 5 Drawing Sheets

ADJUSTABLE BALANCE DRUM SLEEVE CLEARANCE

BACKGROUND

Hydraulic pumps are used in many industries to pressurize a fluid and pump the fluid in a particular direction. A type of hydraulic pump is a multi-stage pump. A multi-stage pump has a number of impellers in series to develop a high pressure. A result of the high pressure is an internal axial force that acts on the pump. When the multi-stage pump is rated to a high pressure, the multi-stage pump is designed with a balance drum to minimize the pump's internal axial load. The balance drum works specifically to reduce the pressure distribution between the suction end and discharge end of the pump. The balance drum reduces the pressure distribution, in part, using a radial clearance between a sleeve of the balance drum and a rotational portion of the balance drum. Over time, the rotational portion of the balance drum becomes worn out and the radial clearance increases. When the radial clearance deviates from the original clearance, the equipment is unable to balance the axial load properly.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for a balance drum. The system includes a balance drum shaft, a rotating balance drum, a stationary balance drum, an adjustable radial clearance, and a gear wheel. The balance drum shaft has a rotational ability. The rotating balance drum is connected to and disposed circumferentially around the balance drum shaft. The stationary balance drum has an outer circumferential surface, an inner circumferential surface, and drum teeth machined into the outer circumferential surface of the stationary balance drum. The stationary balance drum is disposed circumferentially around the rotating balance drum. The adjustable radial clearance is delineated by an outside of the rotating balance drum and the inner circumferential surface of the stationary balance drum. The gear wheel includes gear teeth. The gear teeth and the drum teeth are configured to interact to rotate the stationary balance drum upon rotation of the gear wheel.

The method includes connecting a rotating balance drum to a balance drum shaft, having a rotational ability, and locating a stationary balance drum around the rotating balance drum to create a radial clearance. The stationary balance drum has an outer circumferential surface, an inner circumferential surface, and drum teeth machined into the outer circumferential surface. The radial clearance is delineated by an outside of the rotating balance drum and the inner circumferential surface of the stationary balance drum. The method further includes mating gear teeth of a gear wheel to the drum teeth of the stationary balance drum and adjusting the radial clearance by rotating the gear wheel to rotate the stationary balance drum using an interaction between the gear teeth and the drum teeth.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

A balance drum in a hydraulic pump reduces the internal axial force using a radial clearance between a stationary sleeve of the balance drum and a rotational portion of the balance drum. Over time, the rotational portion of the balance drum becomes worn out and the radial clearance increases. When the radial clearance deviates from the original clearance, the equipment is unable to balance the axial load properly.

Current configurations of balance drums have non-adjustable clearance. Thus, when the radial clearance begins to deviate from the original clearance, the hydraulic pump is disassembled to replace the necessary parts to revert the radial clearance. This operation is complex, costly, and takes a significant amount of time. Therefore, systems and methods that introduce the ability to modify the radial clearance, without overhauling the hydraulic pump, is beneficial. As such, the present disclosures outlines an adjustable stationary sleeve that uses a gear system, integrated with a threading system, to adjust the stationary sleeve within the equipment casing to modify the radial clearance.

Figure 1:
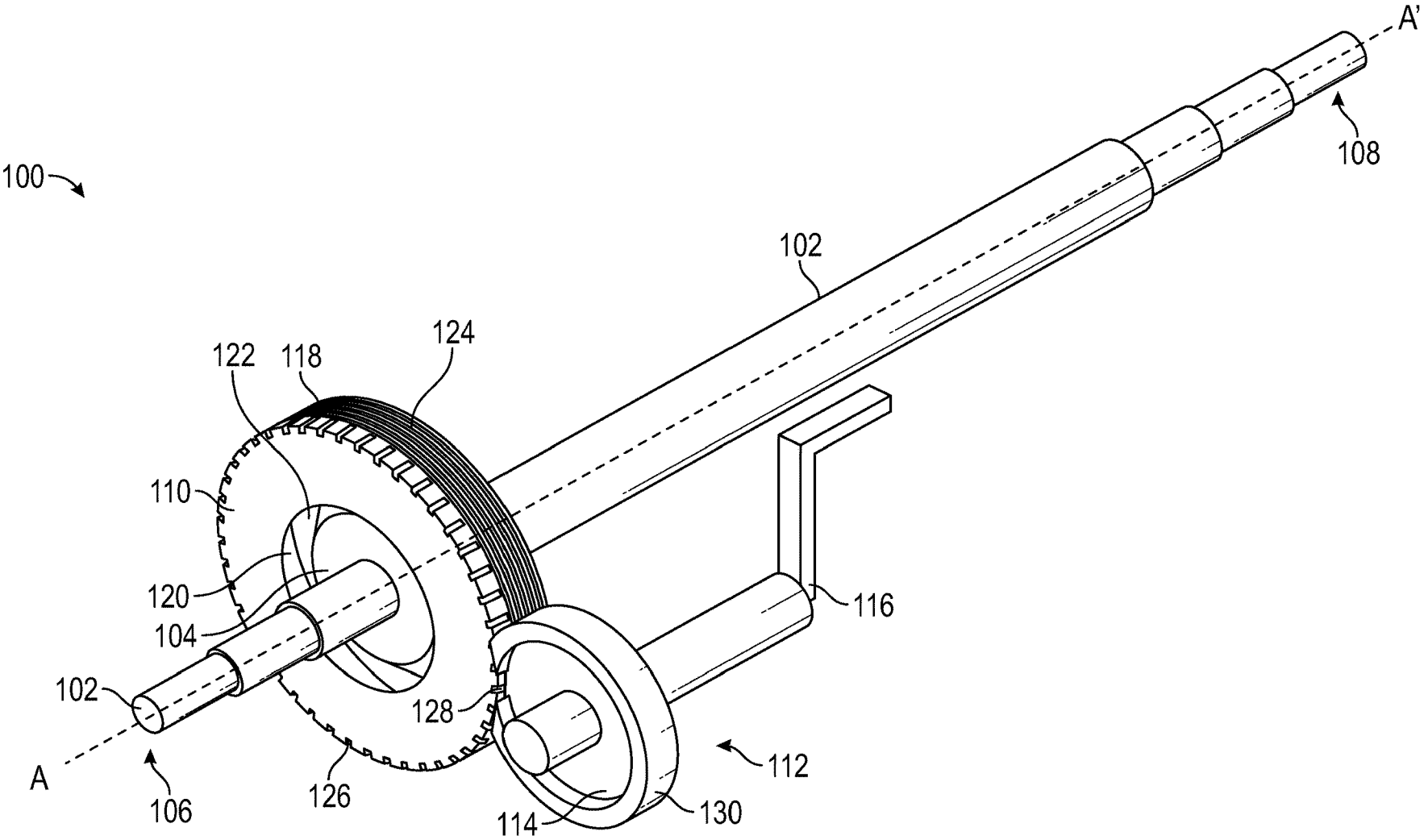
FIG. 1 shows a balance drum in accordance with one or more embodiments.

FIG. 1 shows a balance drum (100) in accordance with one or more embodiments. The balance drum (100) includes a rotational portion and a stationary portion. The rotational portion has the ability to rotate. However, the term "rotational" is not meant to be limiting and the descriptor "rotational" still applies when the components of the rotational portion are not actively rotating.

The rotational portion includes a balance drum shaft (102) and a rotating balance drum (104). In accordance with one or more embodiments, the balance drum shaft (102) is a solid tubular. The balance drum shaft (102) may have a constant outer diameter across the length of the balance drum shaft (102). In other embodiments, and as shown in FIG. 1, the balance drum shaft (102) may have differing outer diameters. For example, the outer diameters may reduce incrementally away from the center of the balance drum shaft (102).

The rotational portion further includes the rotating balance drum (104). The rotating balance drum (104) is connected to the balance drum shaft (102). In accordance with one or more embodiments, the rotating balance drum (104) is circumferentially disposed around the balance drum shaft (102). In further embodiments, the rotating balance drum (104) is connected to the balance drum shaft (102) in such a way that the rotating balance drum (104) may rotate with and at the same speed as the balance drum shaft (102).

For example, the rotating balance drum (104) may be machined as a single component with the balance drum shaft (102), or the rotating balance drum (104) may be welded to the balance drum shaft (102). The balance drum shaft (102) and the rotating balance drum (104) may be formed out of the same material as one another or a different material without departing form the scope of the disclosure herein. Further, the balance drum shaft (102) and the rotating balance drum (104) may be made out of a durable material, such as a metal alloy.

In accordance with one or more embodiments, the rotating balance drum (104) has a circular-shaped cross section. As such, the rotating balance drum (104) may have any shape with a circular cross section, such as a cylinder or a cone frustum, as shown in FIG. 1.

In further embodiments, the balance drum shaft (102) has two ends: a suction end (106) and a discharge end (108). As further outlined in FIG. 3, the suction end (106) is the end of the balance drum (100) where a fluid may enter, and the discharge end (108) is the end of the balance drum (100) where a fluid may exit. The fluid entering and exiting the system in this manner is part of how the balance drum (100) balances the internal axial load created in a hydraulic pump. In accordance with one or more embodiments, the rotating balance drum (104) is connected at or near the suction end (106) of the balance drum shaft (102).

Turning to the stationary portion of the balance drum (100), the term "stationary portion" is used to designate the portion of the balance drum (100) that stays stationary while the rotational portion rotates during operation of a hydraulic pump. However, the term "stationary" is not meant to be limiting and components in the stationary portion of the balance drum (100) may have the ability to rotate without departing from the scope of the disclosure.

The stationary portion includes a stationary balance drum (110) (or "sleeve") and a gear assembly (112). The stationary balance drum (110) and the gear assembly (112) may be made out of any durable material known in the art, such as a metal alloy. The gear assembly (112) includes a gear wheel (114) and a handle (116). The stationary balance drum (110) has an outer circumferential surface (118) and an inner circumferential surface (120). The stationary balance drum (110) is disposed circumferentially around the rotating balance drum (104) such that an adjustable radial clearance (122) is created between the outside of the rotating balance drum (104) and the inner circumferential surface (120) of the stationary balance drum (110).

A series of drum threads (124) are machined into the outer circumferential surface (118) of the stationary balance drum (110). The drum threads (124) may be any type of threads known in the art, such as V-threads, square threads, ACME threads, buttress threads, knuckle threads, Whitworth threads, etc. In further embodiments, a series of drum teeth (126) are also machined into the outer circumferential surface (118).

In accordance with one or more embodiments, the drum teeth (126) mate with a series of gear teeth (128) machined circumferentially around the gear wheel (114). The interaction between the drum teeth (126) and the gear teeth (128) causes reciprocal rotation as with a set of gears. That is, when the gear wheel (114) rotates, the interaction between the drum teeth (126) and the gear teeth (128) causes the stationary balance drum (110) to rotate in an opposing direction to the direction of rotation of the gear wheel (114).

In further embodiments, the gear wheel (114) is connected to the handle (116). The handle (116) may be connected to the gear wheel (114) such that rotation of the handle (116) causes rotation of the gear wheel (114). For example, and as shown in FIG. 1, the handle (116) extends through a center of the gear wheel (114).

In further embodiments. The gear wheel (114) is located inside of a gear casing (130). The gear casing (130) may protect the gear wheel (114) and gear teeth (128) from an external environment of the balance drum (100). In further embodiments, the gear casing (130) connects to the equipment casing (132), shown below in FIG. 4. The gear casing (130) and the equipment casing (132) may be made out of any durable material known in the art, such as a metal alloy.

Figure 2:
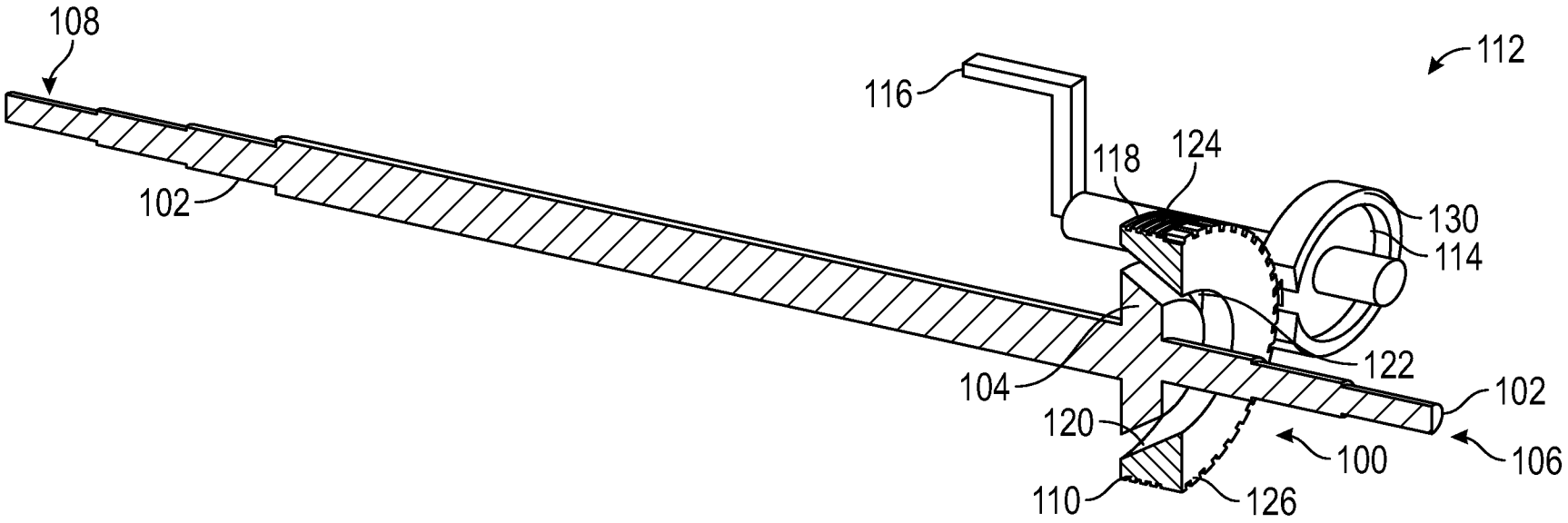
FIG. 2 shows a cross section of the balance drum along axis A-A' in accordance with one or more embodiments.

FIG. 2 shows a cross section of the balance drum (100) along axis A-A' in accordance with one or more embodiments. Components shown in FIG. 2 that are the same as or similar to components shown in FIG. 1 have not been redescribed for purposes of readability and have the same function and description as outlined above.

In accordance with one or more embodiments, the stationary balance drum (110) is formed in the shape of a tubular with a constant outer diameter and a variable inner diameter, as depicted in FIG. 2. Specifically, the inner diameter of the stationary balance drum (110) may increase at a constant rate from the end closest to the suction end (106) of the balance drum shaft (102) to the end closest to the discharge end (108) of the balance drum shaft (102).

Figure 3:
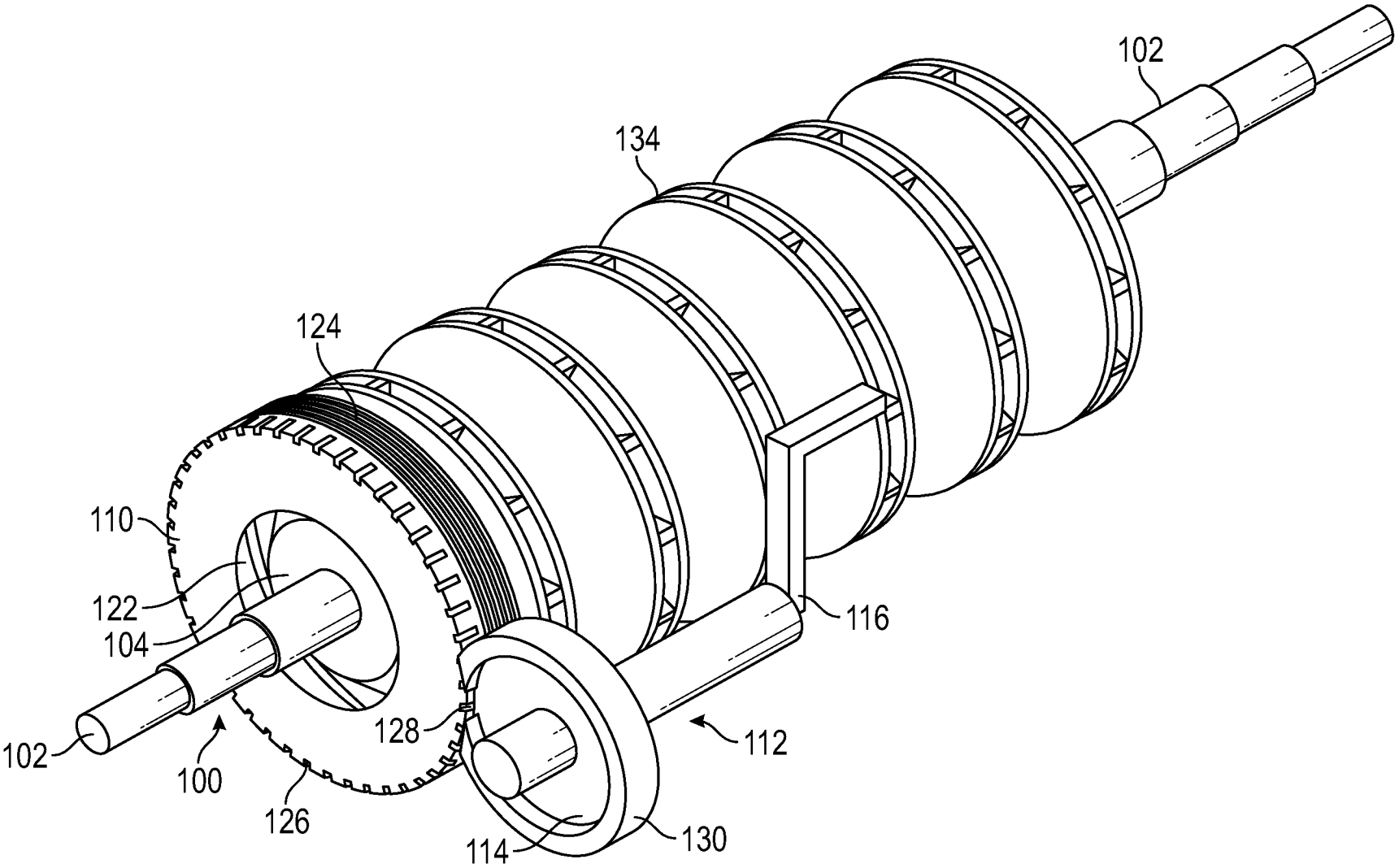
FIG. 3 shows the balance drum installed as part of a hydraulic pump in accordance with one or more embodiments.

FIG. 3 shows the balance drum (100) installed as part of a hydraulic pump in accordance with one or more embodiments. Components shown in FIG. 3 that are the same as or similar to components shown in FIGS. 1 and 2 have not been described again for purposes of readability and have the same function and description as outlined above.

Specifically, FIG. 3 shows a series of impellers (134) installed on the balance drum shaft (102). FIG. 3 shows six impellers (134); however, any number of impellers (134) may be installed on the balance drum shaft (102) without departing from the scope of disclosure herein. A motor (not pictured) may be used to rotate the balance drum shaft (102) which, in turn, rotates the impellers (134). The impellers (134) transfer energy from the motor to a fluid (not pictured) being pumped by accelerating the fluid radially outwards from the center of rotation. The velocity achieved by the impellers (134) transfers into pressure when the outward movement of the fluid is confined by the equipment casing (132).

Figure 4:
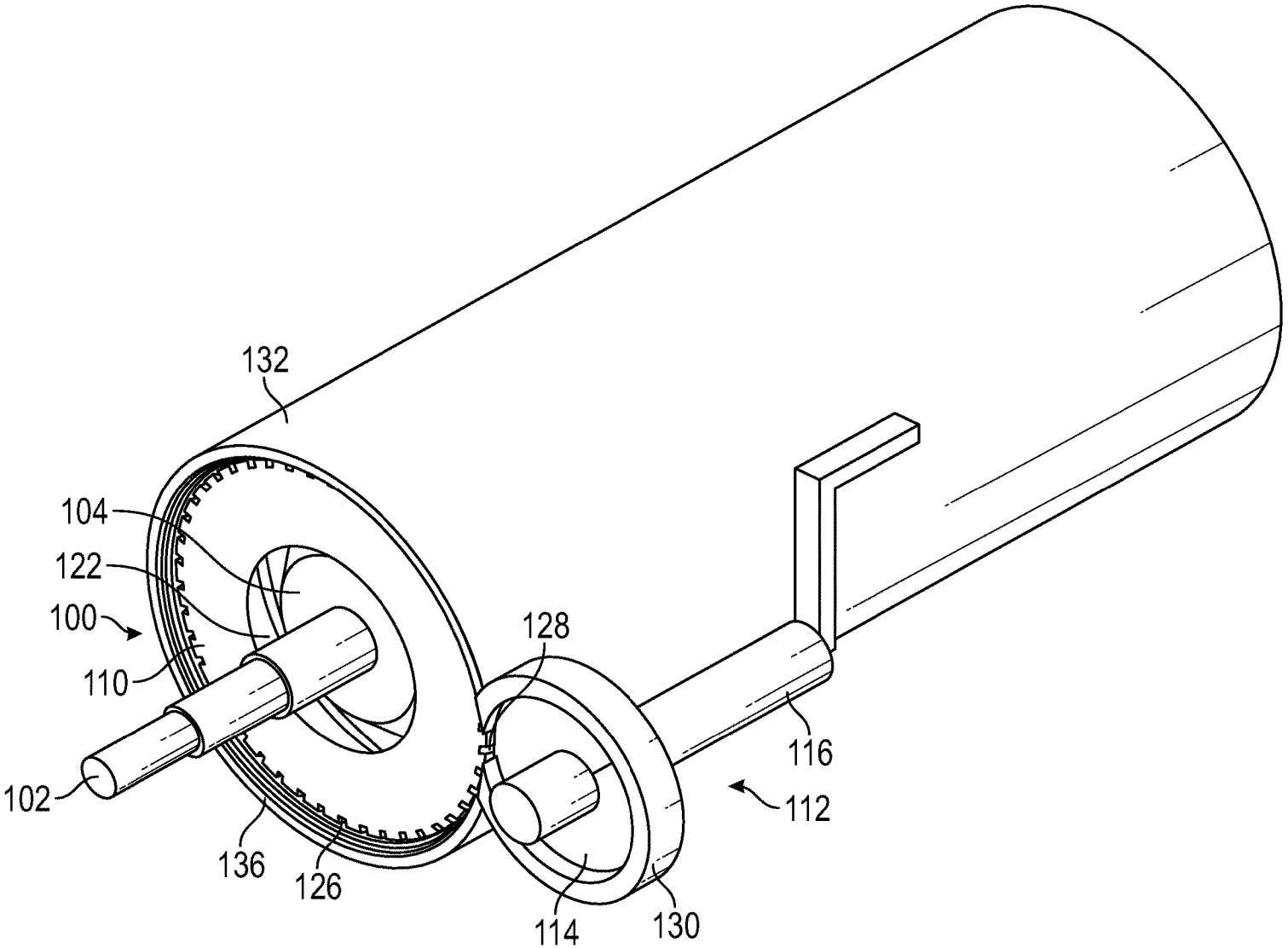
FIG. 4 shows the equipment casing in accordance with one or more embodiments.

FIG. 4 shows the equipment casing (132) in accordance with one or more embodiments. Components shown in FIG. 4 that are the same as or similar to components shown in FIGS. 1-3 have not been redescribed for purposes of readability and have the same function and description as outlined above.

In accordance with one or more embodiments, the balance drum (100) and the impellers (134) are housed within the equipment casing (132) and the gear assembly (112) is housed outside of the equipment casing (132). The equipment casing (132) is a tubular. The equipment casing (132) has a series of casing threads (136) machined onto the inside of the equipment casing (132). The casing threads (136) are designed to interact with the drum threads (124). As such, the stationary balance drum (110) is installed into the equipment casing (132) by threading the drum threads (124) and the casing threads (136) together.

As explained above, when the rotating balance drum (104) becomes worn out during operation of the hydraulic pump, the radial clearance (122) increases. Rather than disassembling the hydraulic pump to replace parts, the handle (116) may be rotated to move the stationary balance drum (110) further inside of the equipment casing (132) to reduce the radial clearance (122).

Specifically, rotation of the handle (116) causes the gear wheel (114) to rotate. As the gear wheel (114) rotates, the stationary balance drum (110) also rotates due to the interaction between the gear teeth (128) and the drum teeth (126). The rotation of the stationary balance drum (110) allows the stationary balance drum (110) to further thread into the equipment casing (132) due to the interaction between the casing threads (136) and the drum threads (124).

Figure 5:
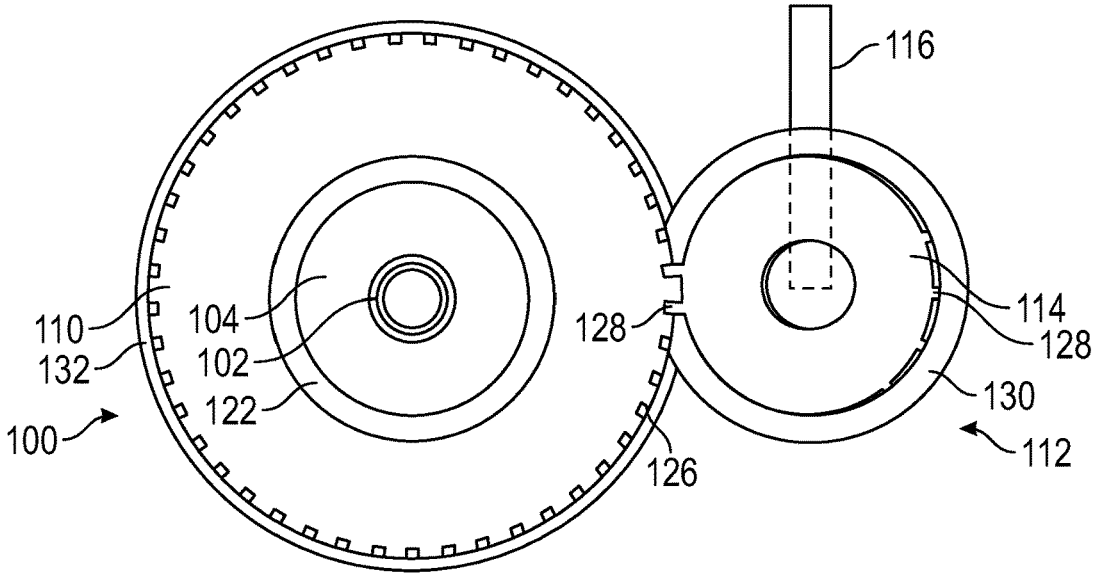
FIG. 5 shows a side view of the balance drum installed in the equipment casing in accordance with one or more embodiments.

FIG. 5 shows a side view of the balance drum (100) installed in the equipment casing (132) in accordance with one or more embodiments. Components shown in FIG. 5 that are the same as or similar to components shown in FIGS. 1-4 have not been redescribed for purposes of readability and have the same function and description as outlined above.

Figure 6:
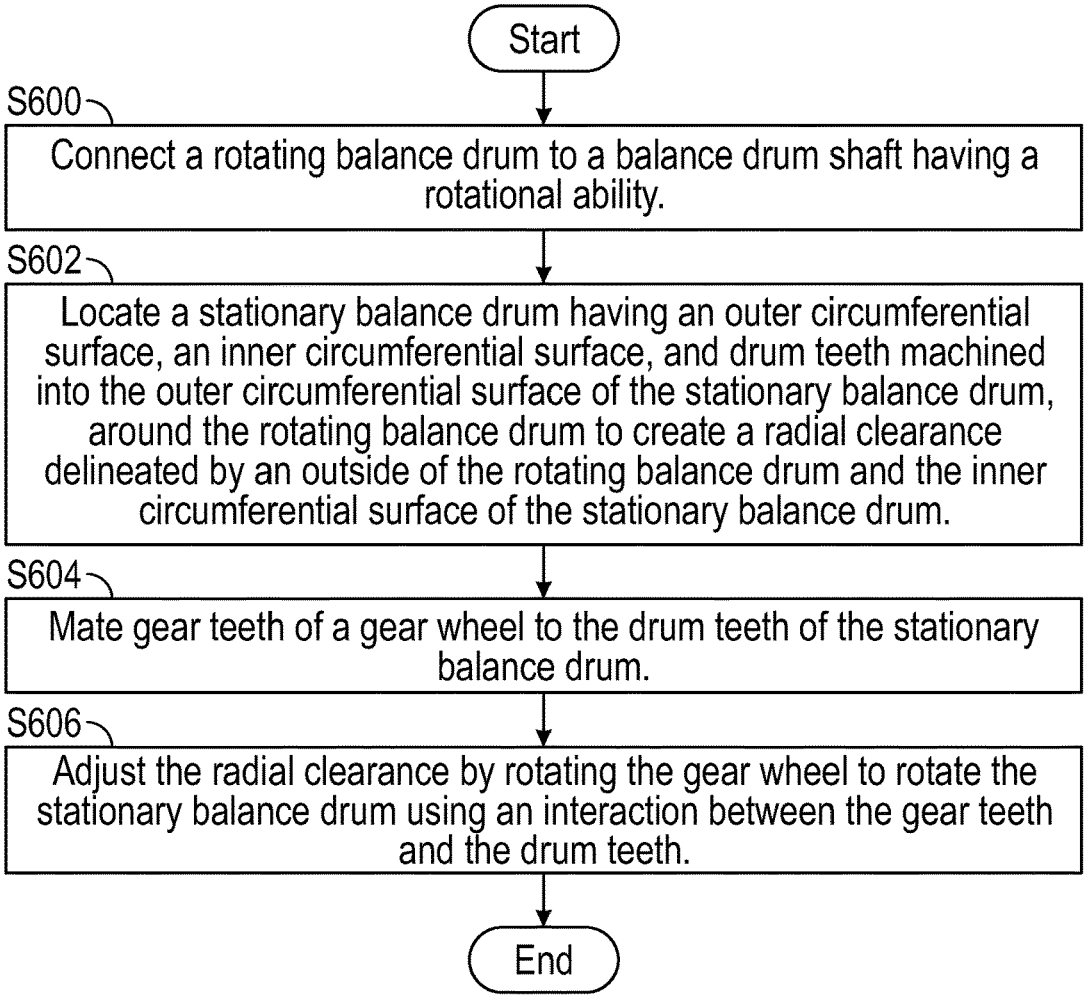
FIG. 6 shows a flowchart in accordance with one or more embodiments.

FIG. 6 shows a flowchart in accordance with one or more embodiments. The flowchart outlines a method for adjusting the radial clearance (122) of the balance drum (100). While the various blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S600, a rotating balance drum (104) is connected to a balance drum shaft (102) having a rotational ability. The rotating balance drum (104) is connected to the balance drum shaft (102) using any means known in the art, such as welding or the two components being machined as one. In further embodiments, the balance drums haft is able to rotate using a motor. As the balance drum shaft (102) rotates, the rotating balance drum (104) also rotates.

In S602, a stationary balance drum (110) having an outer circumferential surface (118), an inner circumferential surface (120), and drum teeth (126) machined into the outer circumferential surface (118) of the stationary balance drum (110), is located around the rotating balance drum (104) to create a radial clearance (122) delineated by an outside of the rotating balance drum (104) and the inner circumferential surface (120) of the stationary balance drum (110).

In accordance with one or more embodiments, the stationary balance drum (110), the rotating balance drum (104), and the balance drum shaft (102) are installed into an equipment casing (132). In further embodiments, one or more impellers (134) are installed onto the balance drum shaft (102) and the impellers (134) are also located in the equipment casing (132). The impellers (134) are installed on the balance drum shaft (102) such that when the balance drum shaft (102) rotates, so do the impellers (134).

In further embodiments, a fluid may be inside the equipment casing (132) and rotation of the impellers (134) causes the fluid to accelerate radially outwards from the center of rotation. The velocity achieved by the impellers (134) transfers into pressure when the outward movement of the fluid is confined by the equipment casing (132). This causes an internal axial force to act inside of the equipment casing (132). The internal axial force is reduced using the balance drum (100) and the radial clearance (122).

In S604, gear teeth (128) of a gear wheel (114) are mated to the drum teeth (126) of the stationary balance drum (110). In accordance with one or more embodiments, a gear casing (130), housing the gear wheel (114), is connected to the equipment casing (132). This allows the gear wheel (114) to connect to the stationary balance drum (110) which is located inside of the equipment casing (132).

In further embodiments, the stationary balance drum (110) is installed inside of the equipment casing (132) using a threading system. Specifically, drum threads (124) are machined into the outer circumferential surface (118) of the stationary balance drum (110), and casing threads (136) are machined onto an inside of the equipment casing (132). The drum threads (124) and the casing threads (136) are threaded together to install the stationary balance drum (110) inside of the equipment casing (132).

In S606, the radial clearance (122) is adjusted by rotating the gear wheel (114) to rotate the stationary balance drum (110) using an interaction between the gear teeth (128) and the drum teeth (126). In accordance with one or more embodiments, rotation of a handle (116) causes the gear wheel (114) to rotate. As the gear wheel (114) rotates, the stationary balance drum (110) also rotates due to the interaction between the gear teeth (128) and the drum teeth (126). The rotation of the stationary balance drum (110) allows the stationary balance drum (110) to further thread into the equipment casing (132) due to the interaction between the casing threads (136) and the drum threads (124).

In further embodiments, the radial clearance (122) may be adjusted as noted above when the rotating balance drum (104) erodes (causing the radial clearance (122) to increase) due to the fluid being pumped through the equipment casing (132). Thus, the stationary balance drum (110) may be pushed further into the equipment casing (132) to reduce the radial clearance (122) back to the original radial clearance (122).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system comprising: a balance drum shaft having a rotational ability; a rotating balance drum connected to and disposed circumferentially around the balance drum shaft; a stationary balance drum, having an outer circumferential surface, an inner circumferential surface, and drum teeth machined into the outer circumferential surface of the stationary balance drum, disposed circumferentially around the rotating balance drum; an adjustable radial clearance delineated by an outside of the rotating balance drum and the inner circumferential surface of the stationary balance drum; and a gear wheel comprising gear teeth, wherein the gear teeth and the drum teeth are configured to interact to rotate the stationary balance drum upon rotation of the gear wheel; wherein the stationary balance drum further comprises drum threads machined into the outer circumferential surface; an equipment casing comprising casing threads machined onto an inside of the equipment casing; and wherein the casing threads are configured to mate with the drum threads.

2. The system of claim 1, wherein the balance drum shaft, the rotating balance drum, and the stationary balance drum are disposed within the equipment casing and the stationary balance drum is installed into the equipment casing using the drum threads and the casing threads.

3. The system of claim 2, wherein the adjustable radial clearance is adjustable due to rotation of the stationary balance drum inside the equipment casing using the gear wheel and interaction between the drum threads and the casing threads.

4. The system of claim 1, further comprising one or more impellers connected to the balance drum shaft and located within the equipment casing.

5. The system of claim 1, further comprising a gear casing housing the gear wheel and connected to the equipment casing.

6. The system of claim 1, wherein the rotating balance drum is formed in a cone frustum-like shape.

7. The system of claim 1, further comprising a handle connected to the gear wheel wherein the handle is configured to rotate the gear wheel.

8. A method comprising: connecting a rotating balance drum to a balance drum shaft having a rotational ability; locating a stationary balance drum having an outer circumferential surface, an inner circumferential surface, and drum teeth machined into the outer circumferential surface of the stationary balance drum, around the rotating balance drum to create a radial clearance delineated by an outside of the rotating balance drum and the inner circumferential surface of the stationary balance drum; mating gear teeth of a gear wheel to the drum teeth of the stationary balance drum; and adjusting the radial clearance by rotating the gear wheel to rotate the stationary balance drum using an interaction between the gear teeth and the drum teeth; installing the stationary balance drum into the equipment casino further comprises threading drum threads, machined into the outer circumferential surface of the stationary balance drum, with casing threads, machined onto an inside of the equipment casing; and mating the casing threads with the drum threads.

9. The method of claim 8, further comprising installing the stationary balance drum, the rotating balance drum, and the balance drum shaft into an equipment casing.

10. The method of claim 9, wherein mating the gear teeth of the gear wheel to the drum teeth of the stationary balance drum further comprises connecting a gear casing, housing the gear wheel, to the equipment casing.

11. The method of claim 8, wherein adjusting the radial clearance further comprises threading the stationary balance drum further into the equipment casing by rotating the stationary balance drum.

12. The method of claim 11, wherein threading the stationary balance drum further into the equipment casing further comprises rotating the gear wheel using a handle.

13. The method of claim 9, further comprising installing one or more impellers on the balance drum shaft.

14. The method of claim 13, further comprising rotating the balance drum shaft to rotate the impellers and the rotating balance drum.

15. The method of claim 14, further comprising creating an internal axial force due to rotation of the impellers.

16. The method of claim 15, further comprising reducing the internal axial force using the radial clearance.

* * * * *